US007658089B2

(12) United States Patent
Zdravkovic et al.

(10) Patent No.: US 7,658,089 B2
(45) Date of Patent: Feb. 9, 2010

(54) AUTOMATED MONITORING FOR CLINCHING JOINTS

(75) Inventors: Srecko Zdravkovic, Sterling Heights, MI (US); Sivakumar Ramasamy, Utica, MI (US)

(73) Assignee: Newfrey LLC, Newark, DE (US)

( * ) Notice: Subject to any disclaimer, the term of this patent is extended or adjusted under 35 U.S.C. 154(b) by 617 days.

(21) Appl. No.: 10/544,932

(22) PCT Filed: Feb. 13, 2004

(86) PCT No.: PCT/US2004/004529

§ 371 (c)(1),
(2), (4) Date: Jun. 6, 2006

(87) PCT Pub. No.: WO2004/074695

PCT Pub. Date: Sep. 2, 2004

(65) Prior Publication Data

US 2006/0243013 A1 Nov. 2, 2006

Related U.S. Application Data

(60) Provisional application No. 60/447,284, filed on Feb. 14, 2003.

(51) Int. Cl.
*B21D 55/00* (2006.01)
*B21C 51/00* (2006.01)

(52) U.S. Cl. ..... 72/3; 72/21.4; 72/465.1

(58) Field of Classification Search ..... 72/1, 72/3, 4, 20.1, 20.2, 21.3, 441, 446, 466.4, 72/466.5, 21.4; 29/407.09, 407.1, 709, 714, 29/715, 703, 702, 720
See application file for complete search history.

(56) References Cited

U.S. PATENT DOCUMENTS

| | | | | |
|---|---|---|---|---|
| 5,150,513 | A | 9/1992 | Sawdon | 29/798 |
| 5,331,831 | A * | 7/1994 | Schneider | 72/4 |
| 5,581,860 | A | 12/1996 | Sawdon | 29/243.5 |
| 6,067,696 | A * | 5/2000 | Cecil et al. | 29/407.01 |
| 6,502,008 | B2 | 12/2002 | Maurer et al. | 700/175 |
| 6,789,309 | B2 | 9/2004 | Kondo | 29/709 |
| 2001/0027597 | A1 | 10/2001 | Mauer et al. | 29/407.04 |
| 2002/0166221 | A1 | 11/2002 | Clew | 29/407.02 |
| 2007/0084045 | A1 * | 4/2007 | Wang et al. | 29/715 |

OTHER PUBLICATIONS

Westgate, S.A., How Do Mechanical Fasteners Measure Up to Spot Welding?, *Mechanical Fastening Seminar*, Troy, Michigan, Jan. 27, 1998.

* cited by examiner

*Primary Examiner*—Dana Ross
*Assistant Examiner*—Debra M Sullivan
(74) *Attorney, Agent, or Firm*—Michael P. Leary; Stephen R. Valancius

(57) ABSTRACT

A system and method for monitoring clinched joints senses lateral displacement of die segments during formation of a joint, which depends on joint button diameter. The system determines whether a joint is acceptable by correlating acceptable button diameter with acceptable amount of punch advancement. A predetermined number of unacceptable joints indicates excessive punch and/or die wear.

18 Claims, 6 Drawing Sheets

AUTOMATED MONITORING FOR CLINCHING JOINTS

CROSS-REFERENCE TO RELATED APPLICATION

This application claims the benefit of Application No. 60/447,284 filed Feb. 14, 2003, incorporated herein by reference.

BACKGROUND OF THE INVENTION

This invention is concerned with clinched joints, and more particularly, with automated monitoring of clinching to ensure the quality of clinched joints, including, but not limited to, the quality of button diameter and button bottom thickness.

Among the well-known ways of joining sheets of metal are so-called clinched joints in which the operation of a punch relative to a die deforms contiguous metal sheets in a manner that produces a joint button interlocking the sheets. One form of clinching apparatus uses a die having die segments that are displaced laterally relative to a die anvil during formation of a joint. See, e.g., U.S. Pat. No. 5,150,513 issued Sep. 29, 1992 and U.S. Pat. No. 5,581,860 issued Dec. 10, 1996. While such clinching apparatus is capable of making excellent clinched joints, there are occasions when the joints are unacceptable, because, for example, the bottom of the joint button is too thin.

BRIEF DESCRIPTION OF THE INVENTION

The present invention provides a system for monitoring the performance of clinching apparatus of the type just described, for determining whether clinched joints are acceptable or unacceptable, and for determining whether wear of the punch and/or die is excessive.

To accomplish this, the invention monitors button diameter and amount of punch advancement in forming a joint, correlates acceptable values of each, indicates when an unacceptable joint has been produced, and indicates when wear of punch and/or die has become excessive.

BRIEF DESCRIPTION OF THE DRAWINGS

The invention will be further described in conjunction with the accompanying drawings, which illustrate preferred (best mode) embodiments, and wherein.

DETAILED DESCRIPTION OF THE INVENTION

Figure 1:
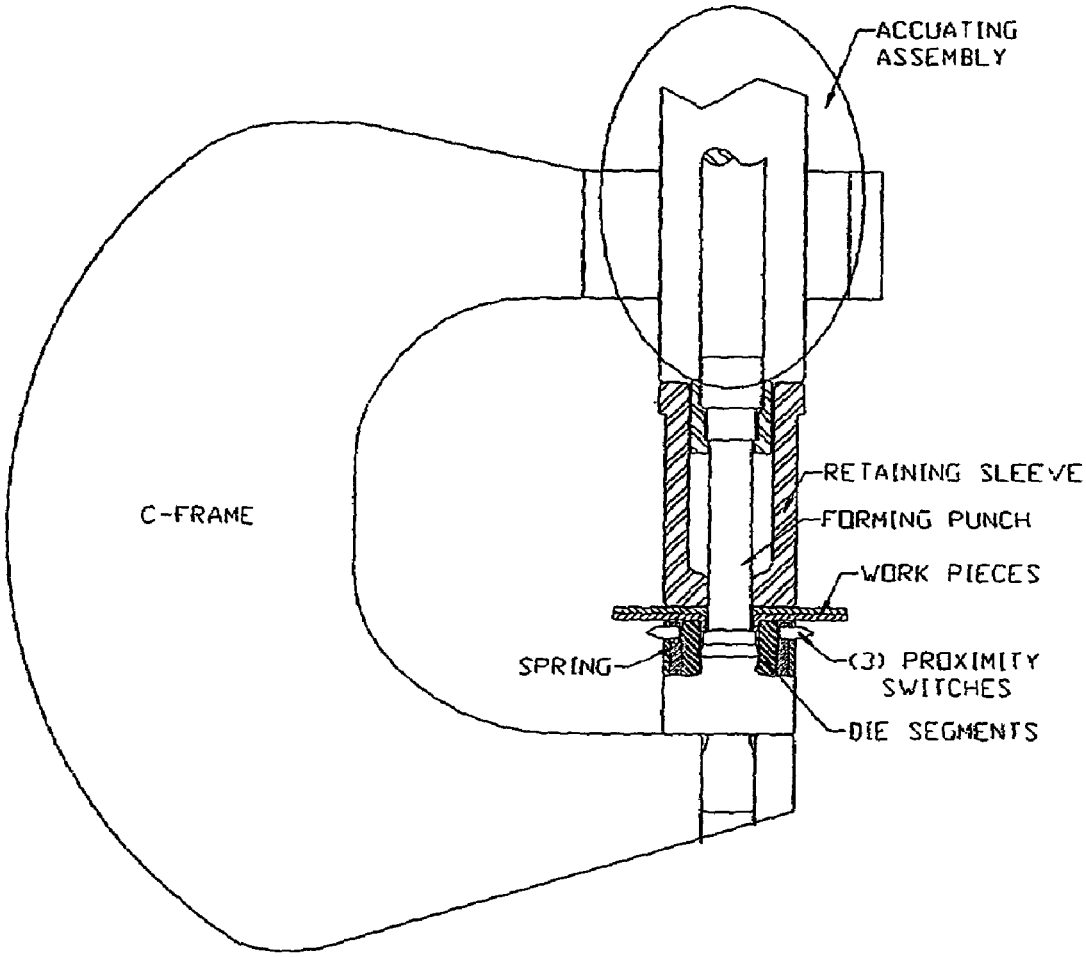
FIG. 1 is a diagrammatic view, partly in section, illustrating one embodiment of clinching apparatus with monitoring components.
Figure 2:
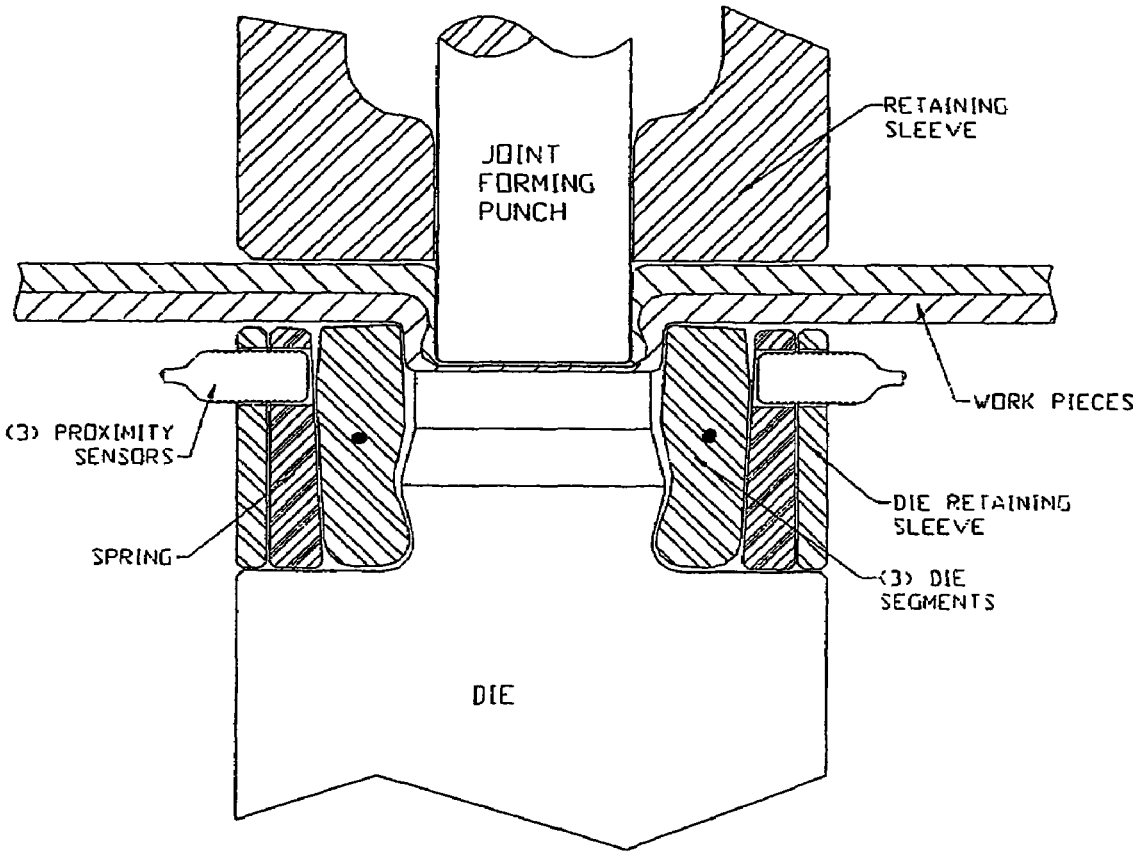
FIG. 2 is a fragmentary enlarged sectional view showing a portion of the apparatus of FIG. 1.

As shown in FIGS. 1 and 2, a machine or apparatus suitable for implementing the invention may comprise a C-Frame, an Actuating Assembly (actuator) mounted on the C-Frame, a Forming Punch supported on the C-Frame for reciprocative movement in a Retaining Sleeve toward and away from a Joint Forming Die (see FIG. 2) and a Controller (see FIG. 4) preferably including a microprocessor. In one embodiment, the Actuating Assembly mounted on the C-Frame is powered by an electrical servo motor, and transfers rotational motion of a planetary roller screw into linear motion of the joint Forming Punch. U.S. Pat. No. 6,502,008 issued Dec. 31, 2002 discloses an example of an actuating assembly suitable for use in the present invention.

Figure 4:
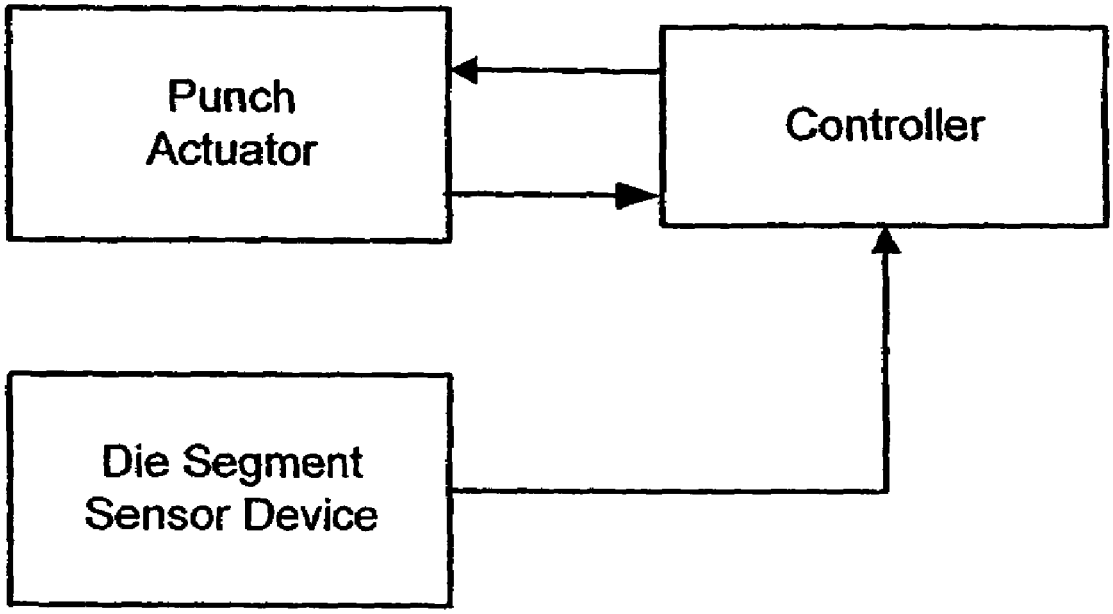
FIG. 4 is a simplified block diagram of monitoring apparatus in accordance with the invention.

In the embodiment shown in FIGS. 1 and 2, the control of button diameter utilizes a sensor device including individual proximity switch sensors that sense displacement of pivoting die segments (e.g. three die segments equally spaced circumferentially) that cooperate with the die anvil and the punch in forming a clinched joint by which work pieces (e.g., sheets of metal) are joined. The proximity switches, more generally sensors, sense displacement of the associated die segments. As shown in FIG. 4, the controller (more particularly, the microprocessor thereof) receives information from the die segment sensor device and controls the punch actuator, which controls the movement of the punch. As the clinching process proceeds and the punch advances toward the die, the die segments are moved outwardly, i.e., laterally relative to the die anvil. When the button diameter reaches a predetermined size, the sensors will signal the microprocessor to stop the punch movement and to start to move the punch backwardly (i.e., retract the punch). FIG. 2 shows, in greater detail, the formation of the button by the cooperation of the punch, the die anvil and the die segments, which are biased inwardly toward the die anvil by springs or other resilient means between the die segments and a die retaining sleeve.

The microprocessor can be used to control the amount of punch movement toward the die, by, e.g., controlling the number of rotations of a servo motor which powers the actuator, in order to control the button bottom thickness. The processor can store information representative of a predetermined range of acceptable button bottom thickness. When the sensors controlling the button diameter, as described above, indicate that a desired button diameter has been reached, and the joint-forming movement of the punch is stopped, the number of rotations of the servo motor up to the time that the punch is stopped will indicate whether the button bottom thickness is within the desired range. As indicated in FIG. 4, the punch actuator supplies such information to the controller. If the punch advances more than a predetermined amount in forming the button, meaning that the button bottom is too thin, this will indicate that the punch and/or the die are worn and need to be replaced.

Figure 3:
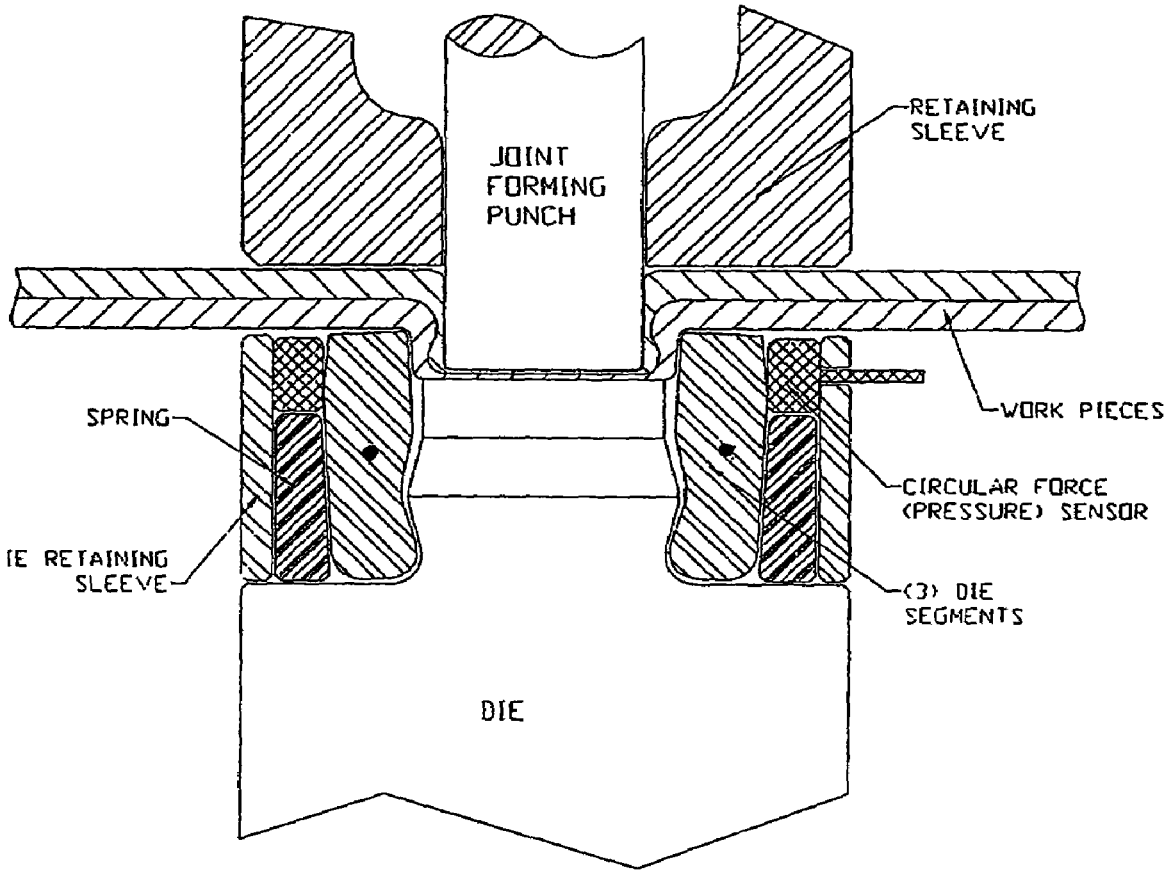
FIG. 3 is a view similar to FIG. 2, but illustrating different monitoring components.

Other types of actuators can be used to drive the punch. Sliding die segments can be used instead of pivoting die segments. Other types of sensors, e.g., strain gauges or load cells, can be used to sense displacement of the die segments. For example, FIG. 3 shows an embodiment in which a circular force (pressure) sensor is used to sense displacement of the die segments. The spring or springs used in each embodiment may be of any appropriate well-known type, such as coil springs, leaf springs, or wave springs. The sensor may be piezoelectric, for example. Appropriate displacement sensors can include electrical, magnetic, optical, mechanical, and electromechanical sensors, for example.

Software employed in a microprocessor of the controller can be designed so that actuation of any one sensor or any combination of sensors can be used to cut off the punch drive. Proximity switches have an on-off operating characteristic, but other sensors may have an operating characteristic that varies continuously or in discrete steps. Time delay between actuations of sensors can be used as a basis for control also. The need for punch/die replacement due to wear can depend upon a predetermined number of clinching cycles in which inappropriate button diameters and/or bottom thickness are detected.

The controller can store information representative of a predetermined range of acceptable button diameters, as well as information representative of a predetermined acceptable range of punch movement. If the punch has to move consistently (within a predetermined number of clinching cycles "X") either more or less than the predetermined range of acceptable punch movement, for the button to reach its predetermined range of acceptable diameter, this will indicate that the punch and/or die are worn out, and that joints need to be examined.

Figure 5:
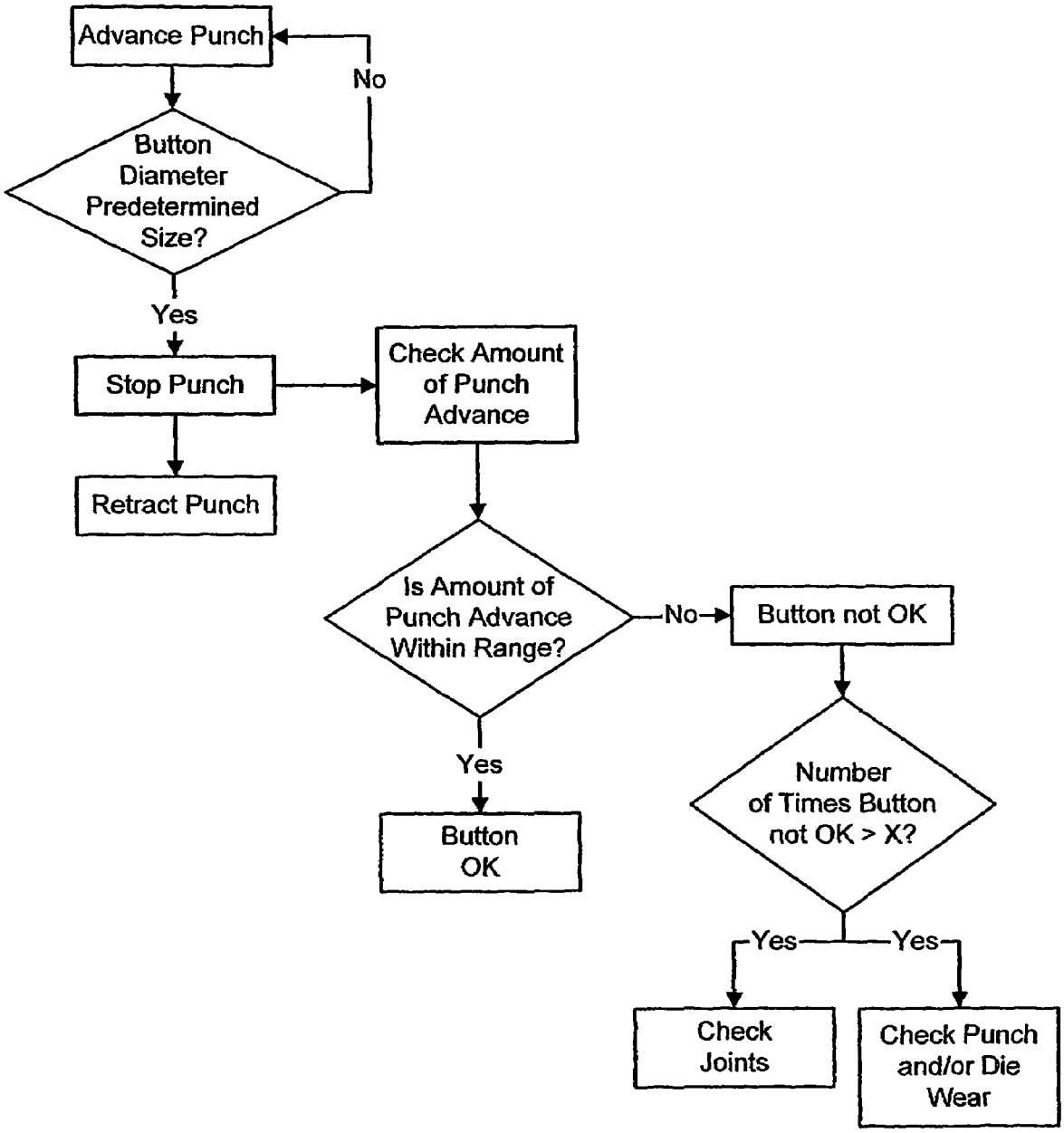
FIG. 5 is a flow chart showing the manner in which clinched joint monitoring can be performed in accordance with the invention.

FIG. 5 is a self-explanatory flowchart illustrating the manner in which a monitoring system of the invention can perform the functions just described. When a button is indicated to be "not o.k." that joint can be checked individually, or joints can be checked as a group after a predetermined number of buttons have been indicated to be "not o.k.".

Figure 6:
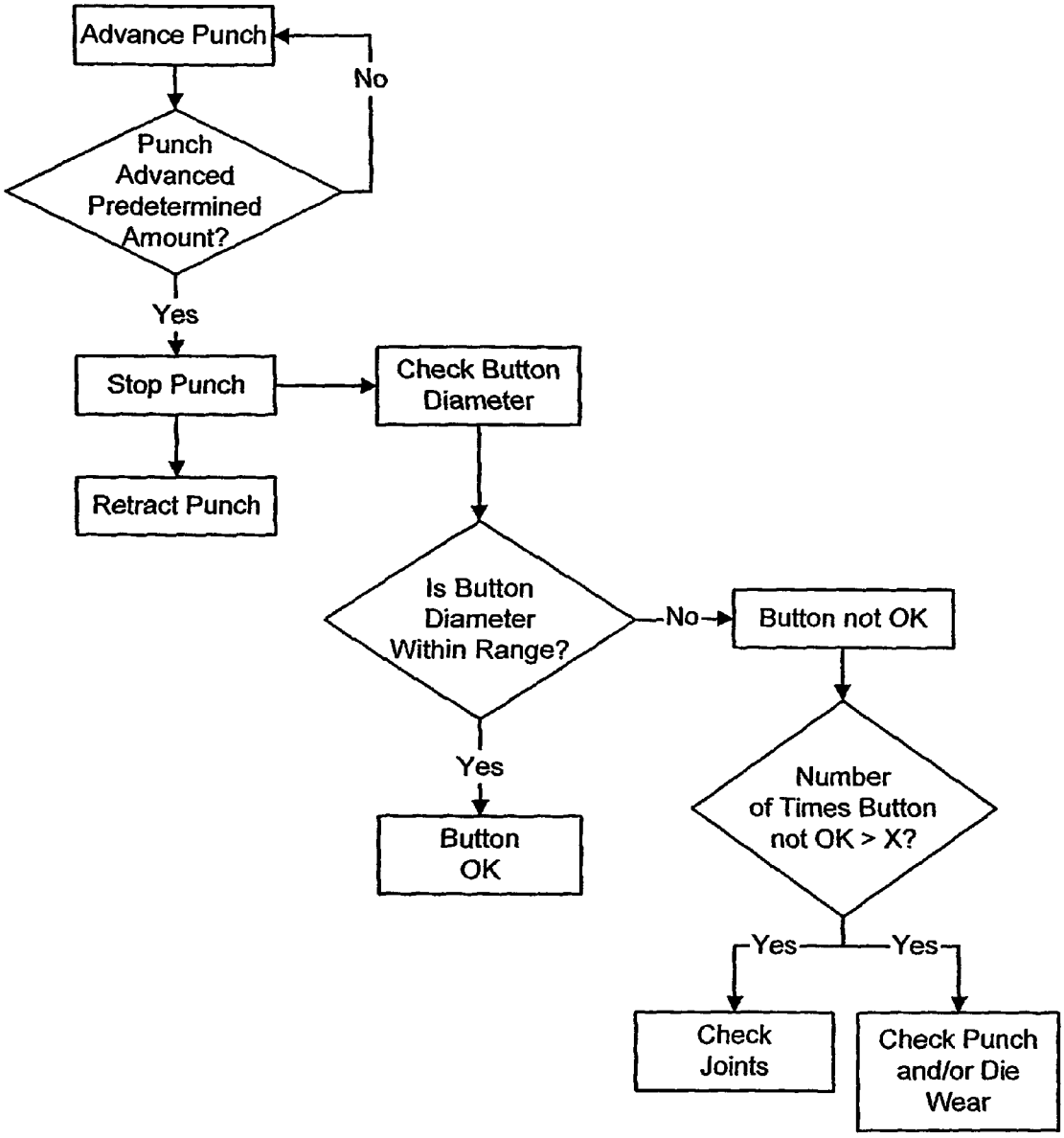
FIG. 6 is a similar flow chart for another embodiment.

In another embodiment, as shown in FIG. 6, for example, instead of stopping punch advancement in response to the sensor device that determines button diameter and then determining joint acceptability by the amount of punch advancement, the controller can direct the actuator to advance the punch and then to stop when the punch advancement is within a predetermined range of acceptable punch advancement, and the output of the sensor device at that time can be used to determine whether the button is within a predetermined range, and hence whether the joint is acceptable. In this embodiment, a sensor device having outputs that vary continuously or in discrete steps is particularly appropriate for determining button diameter.

In general, the controller correlates the size of the button of the clinched joint with the amount of punch advancement in producing the joint and determines from such correlation whether the joint is acceptable.

While preferred embodiments of the invention have been shown and described, it will be apparent that modifications can be made without departing from the principles and spirit of the invention, the scope of which is defined in the appended claims. For example, various described features of the invention can be used individually, or in different combinations of features, as may be desired.

What is claimed is:

1. A system for monitoring clinched joints formed by an apparatus that comprises a punch moved relative to a die by an actuator, and in which, during formation of a clinched joint, die segments move laterally relative to a die anvil, wherein the system comprises:

a sensor device responsive to movement of at least one die segment during formation of a clinched joint for determining a diameter of a button of the clinched joint; and a controller that controls movement of the punch, wherein the controller advances the punch toward the die to form a clinched joint, stops advancement of the punch in response to the sensor device, and then retracts the punch from the die, and wherein the controller determines whether the advancement of the punch in the formation of a clinched joint is within a predetermined range of advancement when the controller stops advancement of the punch.

2. A system according to claim 1, wherein the controller produces an output indicative of an unacceptable joint when the amount of advancement of the punch during formation of a joint is outside of the predetermined range.

3. A system according to claim 2, wherein the controller counts the number of unacceptable joints and produces an output indicative of punch and/or die wear when a predetermined number is counted.

4. A system according to claim 1, wherein the sensor device includes a plurality of sensors responsive to displacement of respective die segments.

5. A system according to claim 1, wherein the sensor device responds to displacement of a plurality of die segments.

6. A system according to claim 1, wherein the sensor device operates with an ON-OFF operating characteristic.

7. A system according to claim 1, wherein the sensor device operates with a continuously variable or discrete-step operating characteristic.

8. A system according to claim 1, wherein the sensor device includes individual sensors that respond to displacement of individual segments and produces an output dependent upon time delay between responses of individual sensors.

9. A system according to claim 1, wherein the controller stores information representative of a predetermined range of acceptable punch advancement and information representative of a predetermined range of acceptable button diameter.

10. A method for monitoring clinched joints formed by an apparatus that comprises a punch moved relative to a die by an actuator, and in which, during formation of a clinched joint, die segments move laterally relative to a die anvil, wherein the method comprises:

using a sensor device to respond to movement of at least one die segment during formation of a clinched joint for determining a diameter of a button of the clinched joint; and using a controller to advance the punch toward the die to form a clinched joint, to stop advancement of the punch in response to the sensor device, then to retract the punch from the die, and to determine whether the advancement of the punch in the formation of a clinched joint is within a predetermined range of advancement movement when the controller stops advancement of the punch.

11. A method according to claim 10, wherein the controller produces an output indicative of an unacceptable joint when the amount of advancement of the punch during formation of a joint is outside of the predetermined range.

12. A method according to claim 11, wherein the controller counts the number of unacceptable joints and produces an output indicative of punch and/or die wear when a predetermined number is counted.

13. A method according to claim 10, wherein the sensor device includes a plurality of sensors that respond to displacement of respective die segments.

14. A method according to claim 10, wherein the sensor device responds to displacement of a plurality of die segments.

15. A method according to claim 10, wherein the sensor device operates with an ON-OFF operating characteristic.

16. A method according to claim 10, wherein the sensor device operates with a continuously variable or discrete-step operating characteristic.

17. A method according to claim 10, wherein the sensor device includes individual sensors that respond to displacement of individual segments and produces an output dependent upon time delay between responses of individual sensors.

18. A method according to claim 10, wherein the controller stores information representative of a predetermined range of acceptable punch advancement and information representative of a predetermined range of acceptable button diameter.

* * * * *